US007562835B2

(12) United States Patent
Chojnacki et al.

(10) Patent No.: US 7,562,835 B2
(45) Date of Patent: Jul. 21, 2009

(54) METHOD AND DEVICES FOR OBTAINING THE CONTINUITY OF THE UNIFORMITY OF THE STRUCTURE AND DENSITY OF A STREAM OF TRANSPORTED LOOSE MATERIAL, PARTICULARLY ORGANIC PLANT MATERIAL, AND PARTICULARLY TOBACCO MATERIAL

(75) Inventors: Wojciech Chojnacki, Radom (PL); Arkadiusz Drużdżel, Radom (PL)

(73) Assignee: International Tobacco Machinery Poland Ltd., Radom (PL)

( * ) Notice: Subject to any disclaimer, the term of this patent is extended or adjusted under 35 U.S.C. 154(b) by 134 days.

(21) Appl. No.: 11/698,421

(22) Filed: Jan. 26, 2007

(65) Prior Publication Data

US 2007/0193592 A1 Aug. 23, 2007

(30) Foreign Application Priority Data

Jan. 27, 2006 (PL) ..... 378835

(51) Int. Cl.
*B02C 18/22* (2006.01)

(52) U.S. Cl. ..... 241/3; 241/101.4; 241/223; 241/242

(58) Field of Classification Search ..... 241/101.2, 241/242, 243, 223, 186.35, 3, 101.4
See application file for complete search history.

(56) References Cited

U.S. PATENT DOCUMENTS 3,185,196 A * 5/1965 Ward ..... 241/101.4
4,172,515 A * 10/1979 Wochnowski ..... 198/524

FOREIGN PATENT DOCUMENTS

| | | | |
|---|---|---|---|
| DE | 17 82 909 | B1 | 2/1976 |
| EP | 0 841 264 | A1 | 5/1998 |
| GB | 2 133 270 | A | 7/1984 |
| WO | WO-03/086114 | A1 | 10/2003 |
| WO | WO-03/099044 | A1 | 12/2003 |
| WO | WO-2004/023902 | A1 | 3/2004 |

OTHER PUBLICATIONS

European Search Report for Application No. 07 10 1227, dated Apr. 26, 2007.

* cited by examiner

*Primary Examiner*—Mark Rosenbaum
(74) *Attorney, Agent, or Firm*—Marshall, Gerstein & Borun LLP

(57) ABSTRACT

The invention relates to a method and a device for obtaining the continuity of the uniformity of the structure and density of a stream of transported loose material, particularly organic plant material, and particularly tobacco material. According to the inventive method, a previously loosened material is compacted during transportation between conveyors, then, the compacted material is comminuted to a form suitable for further processing, and at least one intermediate element, preferably a bracket (5, 6), and thereby also the stream of the compacted material, is vibrated directly before the comminution process. A device according to the invention comprises at least one intermediate vibrating element, preferably this being at least one bracket (5, 6), located transversely to the direction of motion of the material.

24 Claims, 8 Drawing Sheets

METHOD AND DEVICES FOR OBTAINING THE CONTINUITY OF THE UNIFORMITY OF THE STRUCTURE AND DENSITY OF A STREAM OF TRANSPORTED LOOSE MATERIAL, PARTICULARLY ORGANIC PLANT MATERIAL, AND PARTICULARLY TOBACCO MATERIAL

Method and device for obtaining the continuity of the uniformity of the structure and density of a stream of transported loose material, particularly organic plant material, and particularly tobacco material This invention relates to a method and a device for obtaining the continuity of the uniformity of the structure and density of a stream of transported loose material, particularly organic plant material, and particularly tobacco material.

According to the state of the art, loose materials, particularly organic plant materials, and particularly tobacco materials in any of known forms, are subjected to a comminution process as a stage of the whole treatment process. The aim of the comminution process is obtaining particles of sizes, which are suitable for further processing and are best for satisfying the demands for the final product. For example, if the comminuted organic plant material consists of leaves or parts of leaves, particularly tobacco leaves, a typical result of the comminution process are fibers of a desired width and possibly minimal fraction of short particles and dust. Optimal dimensions of the pieces are defined by professionals skilled in the art of processing the material, depending on the type and/or the composition of the processed material.

In order to obtain preferably comminuted material, for example in a form of fibers of desired morphology, devices for comminution are used, in which, firstly, the material loosened previously, particularly organic plant material, is compacted during transportation between belt conveyors, in which the transporting medium is, e.g., a belt made from a uniform material and/or segments connected to each other. Transporting-compacting conveyors are arranged convergently relative to each other so that a desired and preferable compaction of the material can be obtained and the stream of the compacted material is not subjected to sliding in the near-wall zone (belt vs. material) during the transporting and compacting process.

Next, the compacted material is pushed through stationary brackets located between the compacting conveyors and the cutting/comminuting knife, into the zone of direct comminuting, where it is comminuted to a form suitable for further processing, by means of a set of tools for detaching, for example knives. The brackets are fixed immovably, in a fixed position, transversely to the direction of the whole material stream. In the specialist terminology the brackets are called the upper knife and the lower knife, correspondingly, and the set of the both brackets altogether is called the mouthpiece. From the state of the art one can give examples of such typical arrangement for feeding the material to the comminution zone, as for example in U.S. Pat. Nos. 6,634,579 , 4,635,402 (FIG. 1), DE 3222433 (FIG. 1), U.S. Pat. No. 4,456,018 (FIG. 1), EP 1532870 (FIGS. 1 and 2), U.S. Pat. Nos. 4,149,547, 4,172,515.

In the state of the art, the brackets are immovable and due to the direct mechanical contact and the relative motion of the two materials (i.e., the bracket and the processed material) they generate a disadvantageous increase of motion resistance, and therefore generate energy dissipation processes in the near-wall region, the result of which is friction-type heating up of the material, its mechanical degradation (destruction) and disturbance of the uniformity of the stream of the transported material. The above mentioned disadvantageous effects result from additional, disadvantageous friction forces occurring within the stream of the material, mainly sliding friction forces, which, acting on the transported material oppositely to the direction of its motion, increase motion resistance in the near-wall region, this increasing the amount of energy necessary for appropriate feeding the whole stream of the organic plant material to the comminution zone and disadvantageously affecting the uniformity of the material stream fed to the comminution stage.

Directly before the comminution process, the material stream is moved forward by a desired distance beyond the edge of the upper/lower bracket, and then the protruding portion is detached from the main stream by means of a detaching tool, for example a knife. The cycle is repeated, thus the flow and the comminution process being forced.

According to the invention, a method for obtaining the continuity of the uniformity of the structure and density of a stream of transported loose material, particularly organic plant material, and particularly tobacco material, wherein a material, being loosened previously, is compacted during transportation between conveyors, then the compacted material is comminuted to a form preferable for further processing, is characterized in that at least one intermediate element, preferably a bracket, and thereby also the stream of the compacted material, is vibrated directly before the comminution process.

Preferably, at least one intermediate element, preferably a bracket for the stream of the compacted organic plant material, is vibrated in the plane X-Y and/or in the plane Y-Z.

Preferably, at least one intermediate element, preferable a bracket for the stream of the compacted organic plant material, is vibrated along the axis X and/or the axis Y and/or the axis Z.

Spatial orientation of the X-Y-Z coordinate system is defined by three perpendicular X, Y, and Z axes. As seen in FIG. 1A, the X axis is a horizontal axis that is on the same vertical plane as the direction of motion of the material, and the Y axis is a vertical axis. As evident from FIG. 2A, the Z axis is a horizontal axis that oriented perpendicularly to both the X and Y axes, and is parallel (tangent) to the length of the cutting edge of the knife 7, and is also parallel to the cutting edges A, C of the brackets 5, 6.

At least one intermediate element, preferable a bracket for the stream of the compacted organic plant material, is vibrated with an amplitude in the range from 0 to 4 mm, preferably 0 to 2 mm, particularly 0 to 1 mm. Very small relative motions cause a splitting of the bracket material and the transported material in the region of contact.

The frequency of the vibrations is in the range from 20 Hz to 50 kHz.

Preferably, the vibration parameters are set constant.

Vibration parameters for each intermediate element, preferably a bracket, are set and controlled independently.

Each intermediate element, preferably a bracket, has different vibration parameters.

Both intermediate elements, preferably brackets, have the same vibration parameters.

A force necessary for vibrating at least one intermediate element, preferably a bracket, is measured and analyzed as a diagnostic signal indicating the correctness of the process.

A moment of the driving force driving the driving rollers is measured and analyzed as a diagnostic signal for optimization of the vibration motion of at least one intermediate element, preferable a bracket.

Furthermore, a moment of the driving force driving the driving rollers is measured and analyzed as a diagnostic signal and a control signal for minimizing the force stretching the transporting elements which transport/compact the processed material.

Preferably, a moment of the driving force driving the driving rollers is measured and analyzed as a control signal for a device feeding the processed material to transporting elements.

A device for obtaining the continuity of the uniformity of the structure and density of a stream of transported loose material, particularly organic plant material, and particularly tobacco material, comprising a set of conveyors, behind which brackets are located in a mouthpiece before a comminuting knife, is characterized in that it comprises at least one vibrating intermediate element.

The vibrating intermediate element is at least one bracket located transversely to the direction of motion of the material.

The brackets are mounted to a support via a movable assembly of eccentric elements comprising an eccentric roller or an assembly of rollers installed eccentrically in an opening/openings inside the brackets.

In an alternative embodiment the brackets are mounted to a support via a movable assembly of eccentric elements comprising an eccentric roller or an assembly of rollers installed eccentrically outside the brackets.

Preferably, the brackets are mounted to a support via a movable assembly of magnets with the same poles N-N or S-S interacting cyclically, and the magnets are permanent magnets or electromagnets.

Furthermore, the brackets are connected to piezoelectric transducers and/or magnetostriction transducers, which generate the vibrational motion of the brackets.

Preferably, the brackets are connected with an assembly of hydraulic and/or pneumatic cylinders, which generate the vibrational motion of the brackets.

According to the invention, a method and a device for decreasing motion resistance of a stream of transported and compacted loose material, particularly organic plant material, particularly tobacco material, allows for obtaining the continuity of the uniform structure and density of transported loose material, particularly organic plant material, and, as a result, significant improvement of the quality of the comminuted material, particularly organic plant material, fed into the comminution zone by compacting conveyors and pushed through transverse brackets.

The decrease of motion resistance in this zone causes a significant increase of the uniformity of the stream of loose organic plant material, particularly tobacco material, which is manifested in that the uniformity of the material is preserved across the whole section of the material stream, the material stream is not being impeded and degraded in the near-wall layer, and, as a result, the comminution process gives a product of much better quality properties, for example with significantly reduced fraction of pulled out, improperly detached particles of the material, and the width of the fibers of the comminuted material is stable within a significantly narrowed range of the standard deviation. Moreover, the product, which has been properly polarized, compacted, and has not been degraded mechanically in the near-wall layer due to the friction against the brackets, is being properly/correctly comminuted and is not being subjected to further degradation by detaching elements, like comminuting knives.

The effect of the beneficial vibrations of the brackets is a decrease of the coefficient of sliding friction between the brackets and the material being pushed therebetween into the comminution zone, thus decreasing motion resistance related to pushing a loose material, particularly organic plant material, over the surface of the brackets.

The bracket vibrations generated according to the invention beneficially affect the interacting parts and/or subassemblies, for example belts/chains transporting and compacting the processed material. Furthermore, the vibrations beneficially clean the interacting parts and/or subassemblies, for example belts/chains transporting and compacting the processed material. Also, the vibrations beneficially affect the interacting parts and/or subassemblies, and cause the effect of cleaning, for example the tool for detaching (the knife) the processed material.

The invention will be now described with reference to a particular embodiment and accompanying drawings, in which.

Figure 1:
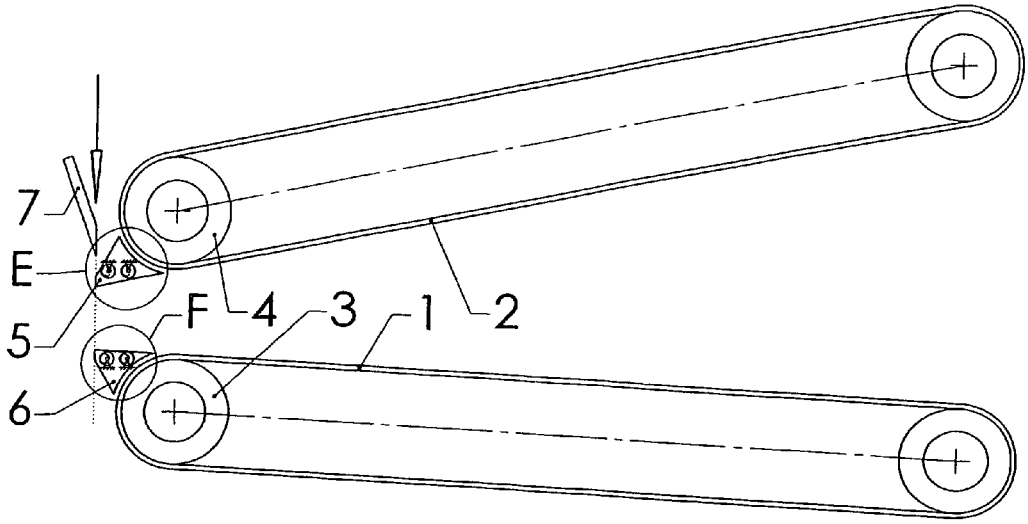
FIG. 1 shows a schematic side view of one embodiment of a device according to the invention, in which the vibrational motion of the brackets is generated in the plane X-Y.

In a method according to the invention, one generates vibrations of at least one intermediate element, preferably a bracket 5, 6, in the path of organic plant material, located transversely to the direction of motion of the material. The generated vibrations of the brackets 5, 6, may have different parameters for each of the brackets, i.e., the resultant direction of displacement of a bracket 5, 6, the amplitude of displacement, as well as the frequency of the vibrations may be controlled individually for each of the brackets in a desired range. The resultant direction of displacement of a bracket is controlled spatially, i.e., each spatial component of the motion is controlled separately. Spatial components of the amplitude of motion of each of the bracket are controlled in the plane X-Y (FIG. 1 or FIG. 3) or in the plane Y-Z (FIG. 2 or FIG. 4), in the range from 0 to 4 mm, particularly preferably in the range from 0 to 2 mm, especially to 1 mm. The frequency of the vibrational motion is set in the range from 20 Hz to 50 kHz. A specific combination of the above mentioned parameters of the vibrational motion, i.e., the amplitude and the frequency of the motion, may be set permanent, for example as a parameter of a comminuting machine, or it may be set by an operator, depending on technological demands, for example for another kind of a comminuted material. Furthermore, the vibration parameters for the bracket 5, 6 are controlled separately. Each of the brackets 5, 6 may have different vibration parameters.

In an embodiment both brackets 5, 6 may have the same vibration parameters.

In a method according to the invention one measures the force necessary for vibrating at least one intermediate element, preferably a bracket 5, 6, and analyzes it as a diagnostic signal indicating the correctness of the process.

In a method according to the invention one can measure a moment of the driving force driving the driving rollers 3, 4 and analyze it as a diagnostic signal for optimization of the vibration motion of at least one intermediate element, preferable a bracket 5, 6.

Furthermore, a moment of the driving force driving the driving rollers 3, 4 may be measured and analyzed as a diagnostic signal and a control signal for minimizing the force stretching the transporting elements which transport/compact the processed material.

Also, one can measure and analyze a moment of the driving force driving the driving rollers 3, 4, as a control signal for a device feeding the processed material to transporting elements.

Figure 2:
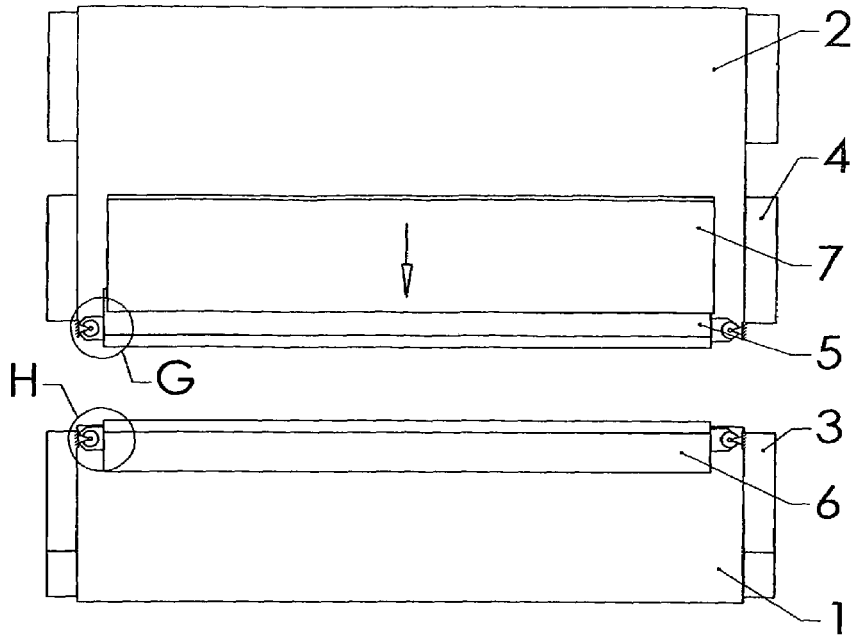
FIG. 2 shows a schematic front view of second embodiment of a device according to the invention, in which the vibrational motion of the brackets is generated in the plane Y-Z.
Figure 3:
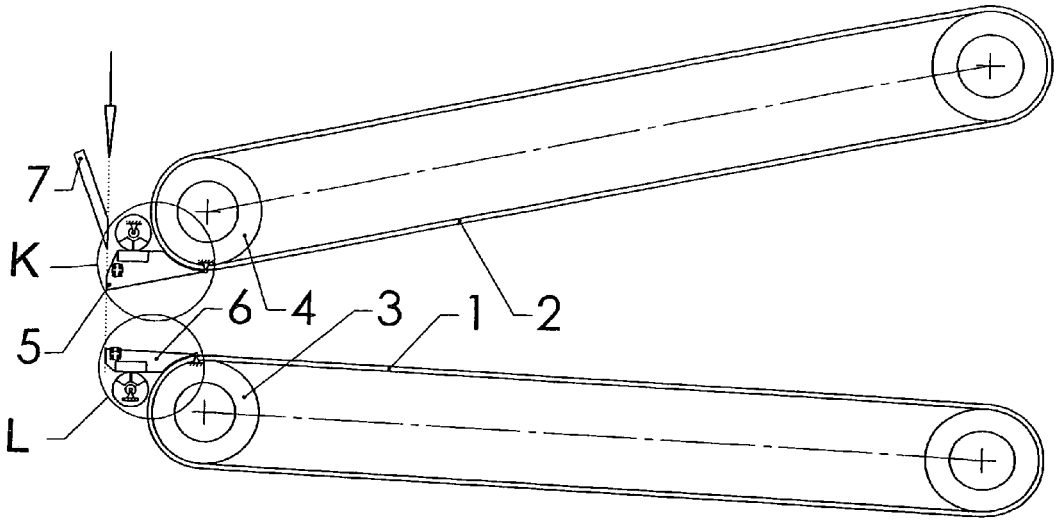
FIG. 3 shows a schematic side view of another embodiment of a device according to the invention, in which the vibrational motion of the brackets is generated in the plane X-Y by means of magnetic reactions between magnets.

In the embodiment shown in FIGS. 1-4 a stream of loose organic plant material, particularly tobacco material in any of known forms, is transported and compacted simultaneously by transporting elements, in which the upper driving roller 4 drives the upper transporting-compacting chain or belt 2, while the lower driving roller 3 drives the lower transporting-compacting chain or belt 1. Then, the stream of the organic plant material is pushed within a mouthpiece, i.e., into the cutting/comminuting zone, over working surfaces A-B of the upper bracket 5 and surfaces C-D of the lower bracket 6. The material stream is moved forward by a desired distance beyond the line A-C and the protruding portion of the material is detached/cut off along the line A-C by a detaching element, for example a blade of the comminuting knife 7, which travels between two extreme edges of the upper bracket 5 and the lower bracket 6, along the line A-C (FIGS. 1 and 3). According to the invention, a device for obtaining the continuity of the uniformity of the structure and density of a stream of transported loose material, particularly organic plant material, and particularly tobacco material, comprises at least one vibrating intermediate element, which, according to an embodiment of the invention, is at least one bracket 5, 6.

In the embodiment shown in FIG. 1 brackets 5 and 6 are mounted to a support 10 via a movable assembly of eccentric elements so that to enable vibrational motion of the brackets 5, 6, the vibrational motion of the brackets is made in the plane X-Y (FIG. 1) and/or in the plane Y-Z (FIG. 2). The manner of generating the motion also enables the motion of the bracket 5, 6 only along one axis, for example the axis X or the axis Y (FIG. 1) or along the axis Z (FIG. 2). The brackets 5, 6 are mounted to a support 10, which may be the frame of the machine, or as shown in the embodiment of FIG. 1, or as shown in the embodiment of FIG. 2. In this embodiment the brackets 5, 6 are mounted to the support 10 via a movable assembly of eccentric elements, which comprises an unbalanced, vibrating mechanical system, for example an eccentric roller or a set of rollers installed eccentrically, for example in an opening/openings inside the brackets 5, 6, as shown in FIGS. 1 and 2. The opening may be a through opening. Alternatively, non-through openings may be made at both ends of the brackets 5, 6. In an alternative embodiment, the eccentric roller/rollers may be located only at the ends of the brackets 5, 6, for example outside the brackets (not shown in the drawing).

Figure 1A:
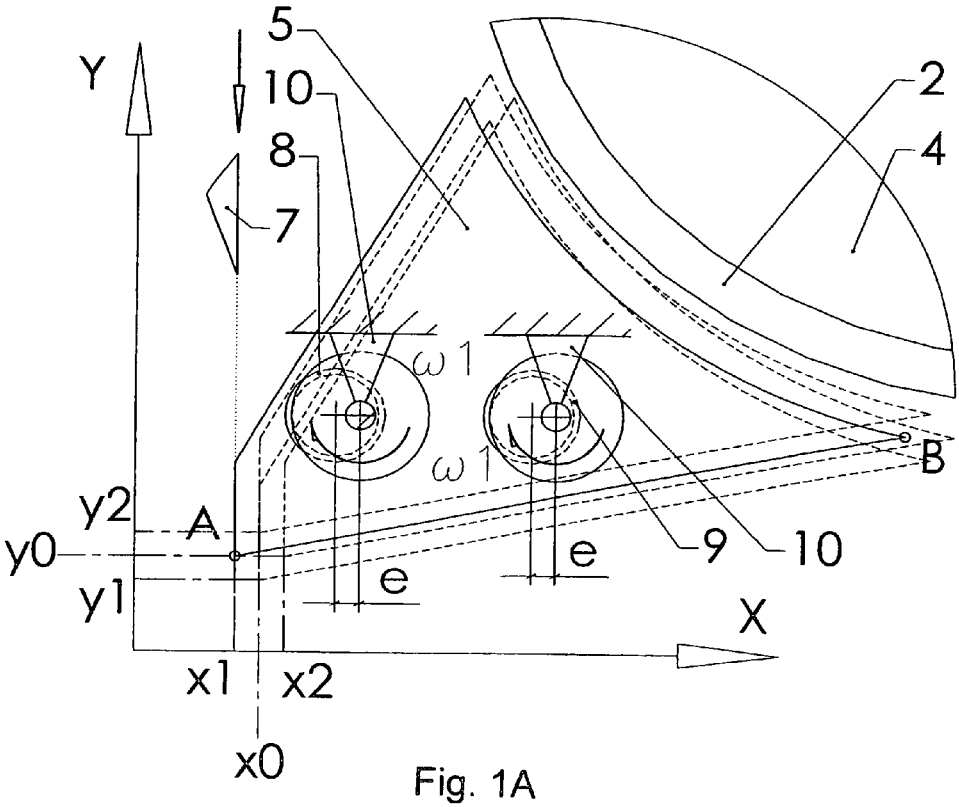
FIG. 1A shows an enlarged detail E from FIG. 1.
Figure 1B:
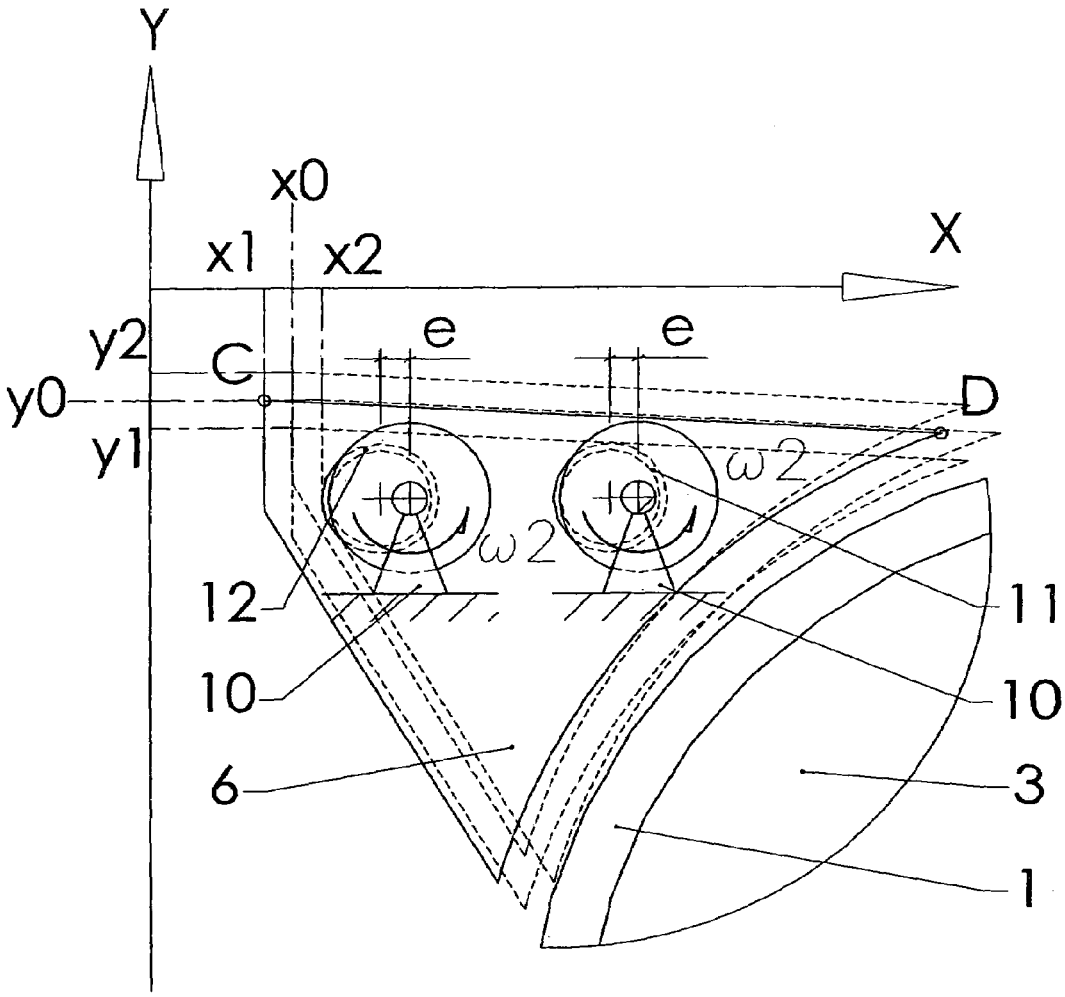
FIG. 1B shows an enlarged detail F from FIG. 1.
Figure 2A:
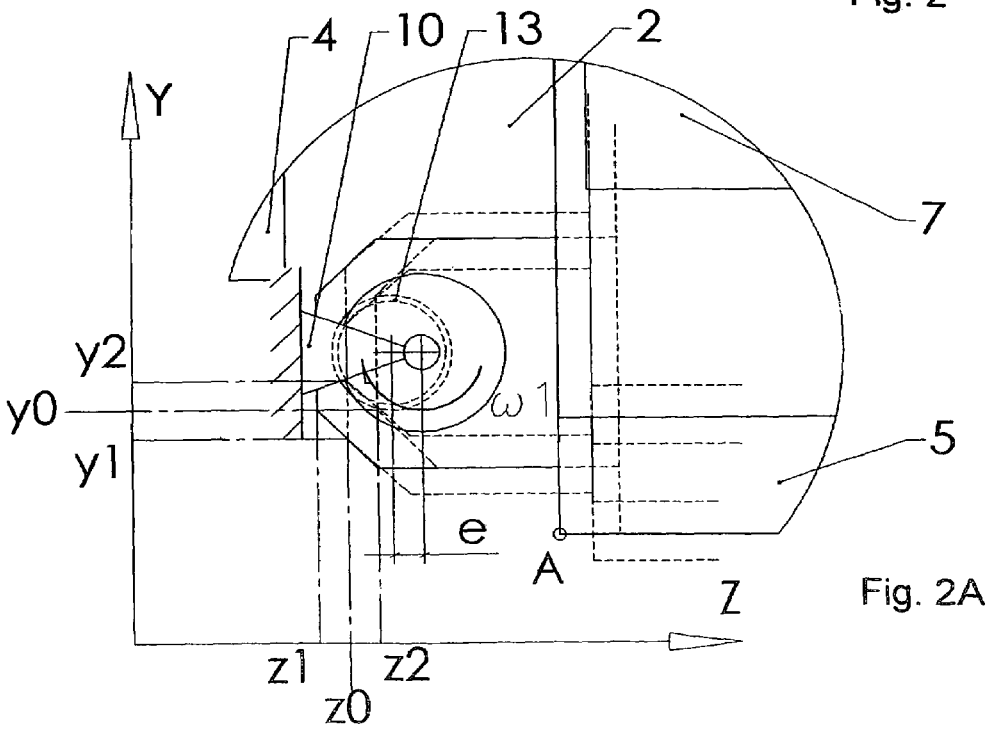
FIG. 2A shows an enlarged detail G from FIG. 2.
Figure 2B:
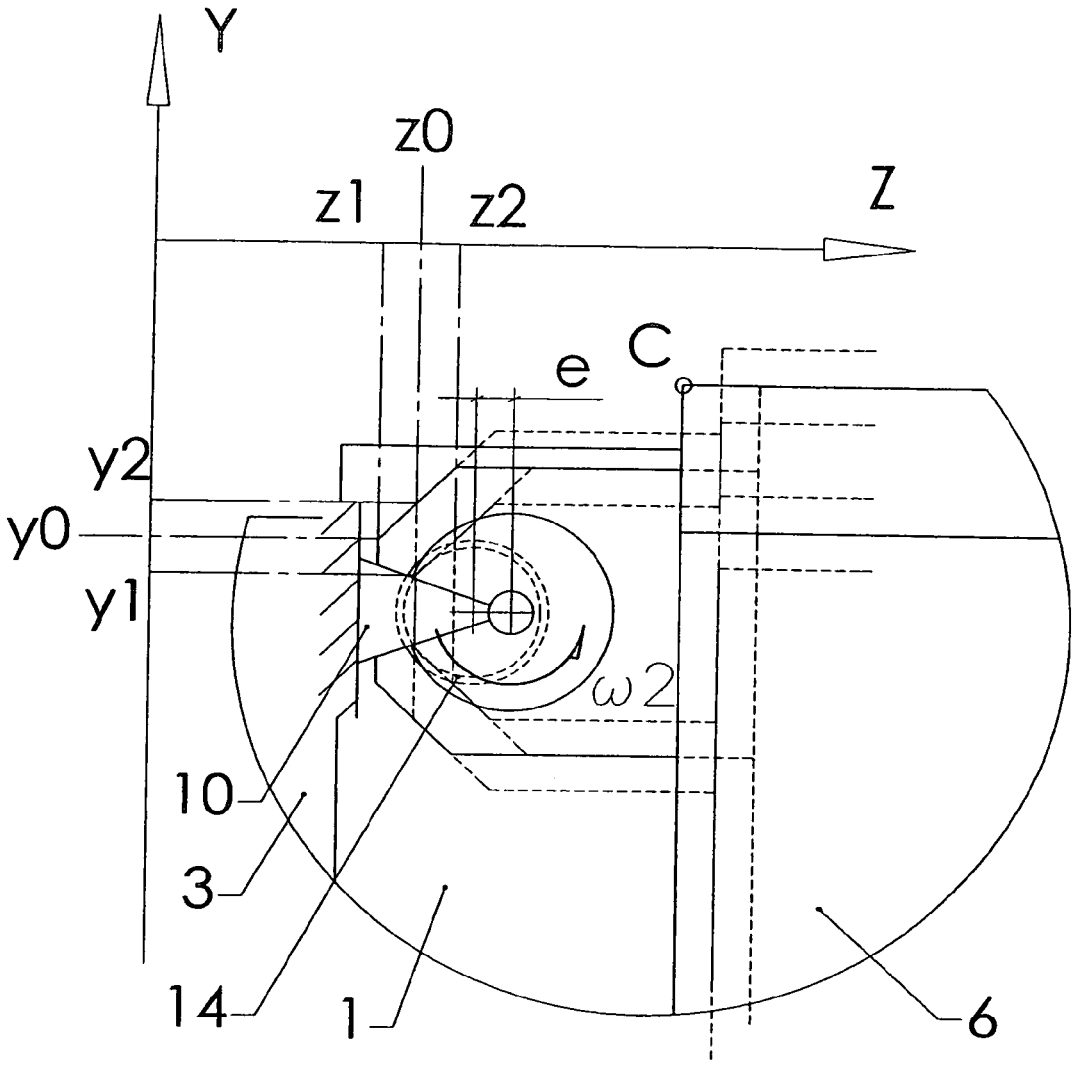
FIG. 2B shows an enlarged detail H from FIG. 2.

Motion parameters are set and controlled individually for each of the brackets, enabling them to displace from the starting position (equilibrium position), denoted as x0 and y0 in FIGS. 1A and 1B, details E and F, and y0 and z0 in FIGS. 2A and 2B, details G and H, in the desired range from x1 to x2, from y1 to y2 and from z1 to z2, correspondingly, in the plane X-Y or in the plane Y-Z (FIG. 2). In the presented embodiment, the amplitude and frequency of the vibrational motion of the brackets 5, 6 are forced by the eccentric roller or the set of rollers 8, 9 and 11, 12, 13, 14, installed eccentrically inside the brackets, the resultant amplitude of the motion being set by a corresponding shift of the internal roller/rollers 8, 9 and 11, 12, 13, 14 in the openings/opening of the brackets 5 and 6 by the eccentric element parameter e [mm], as shown in FIGS. 1 and 2. The frequency of the vibrational motion is controlled by the frequency ω1 [1/s], ω2 [1/s] of the eccentric rollers 8, 9 and 11, 12, 13 in the given range.

Figure 3A:
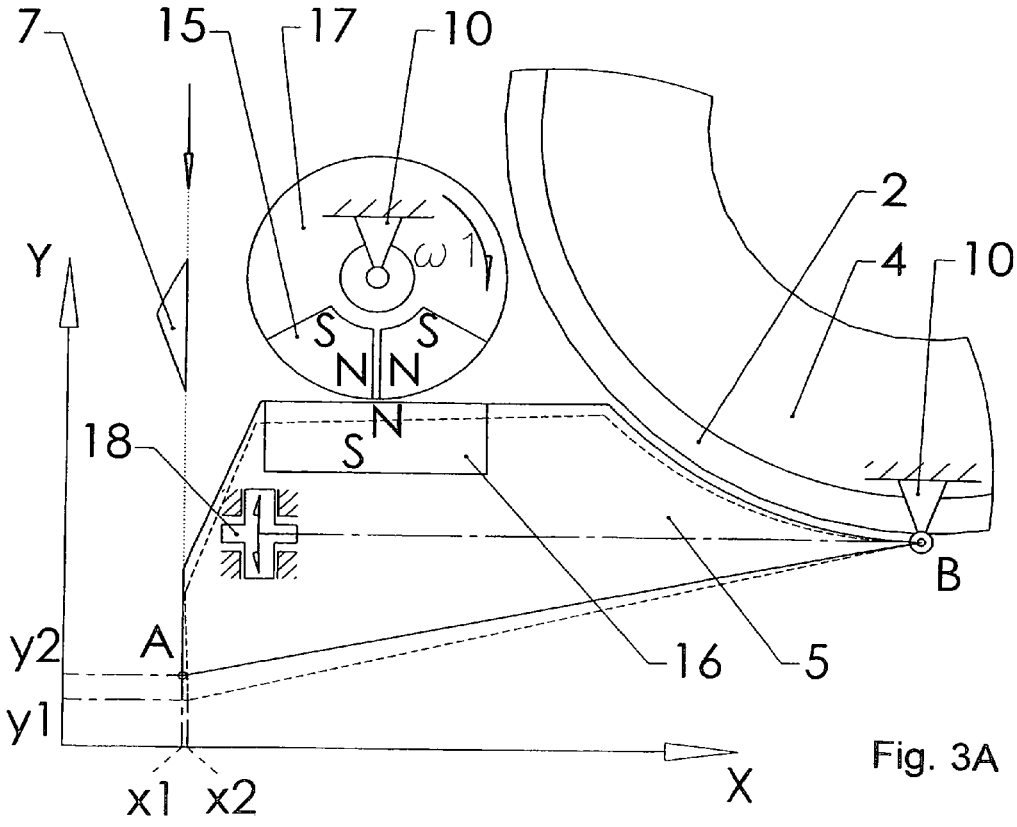
FIG. 3A shows an enlarged detail K from FIG. 3.
Figure 3B:
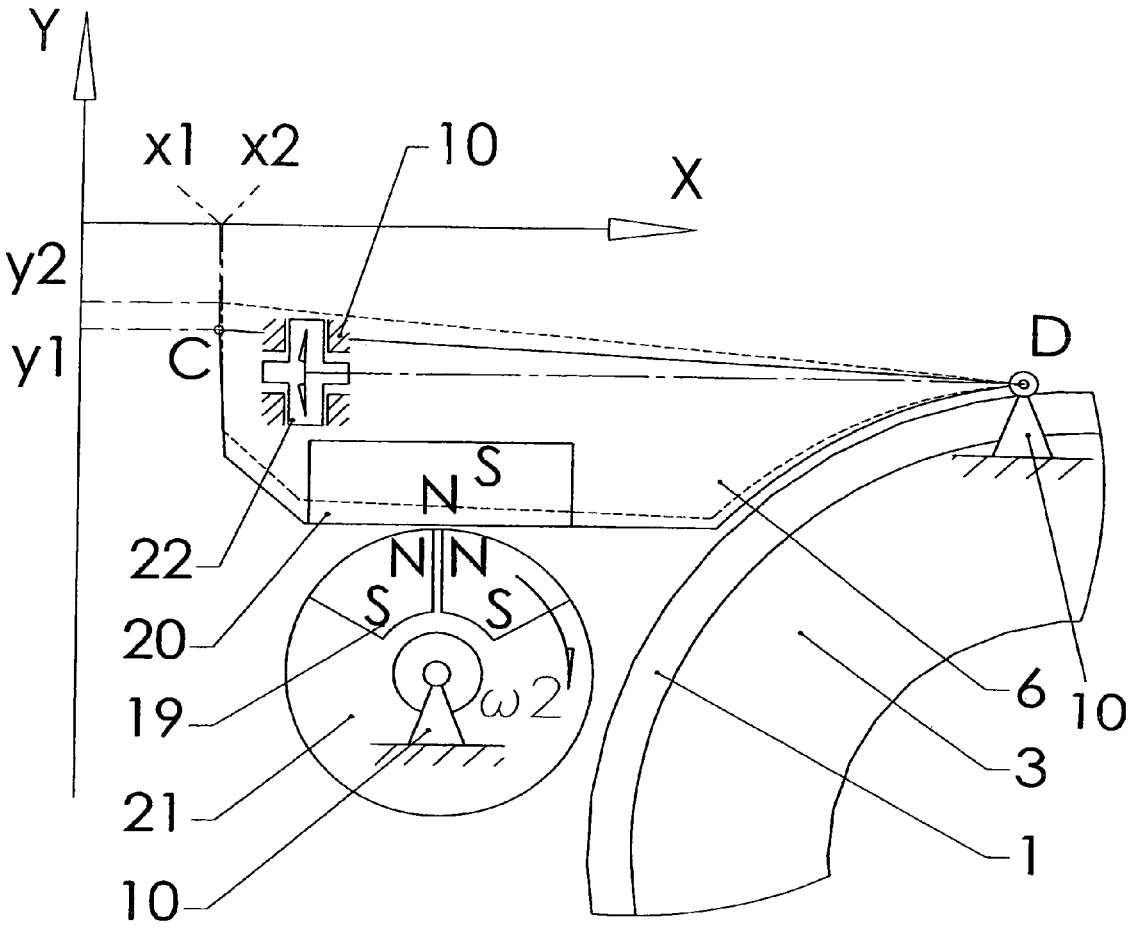
FIG. 3B shows an enlarged detail L from FIG. 3.
Figure 4:
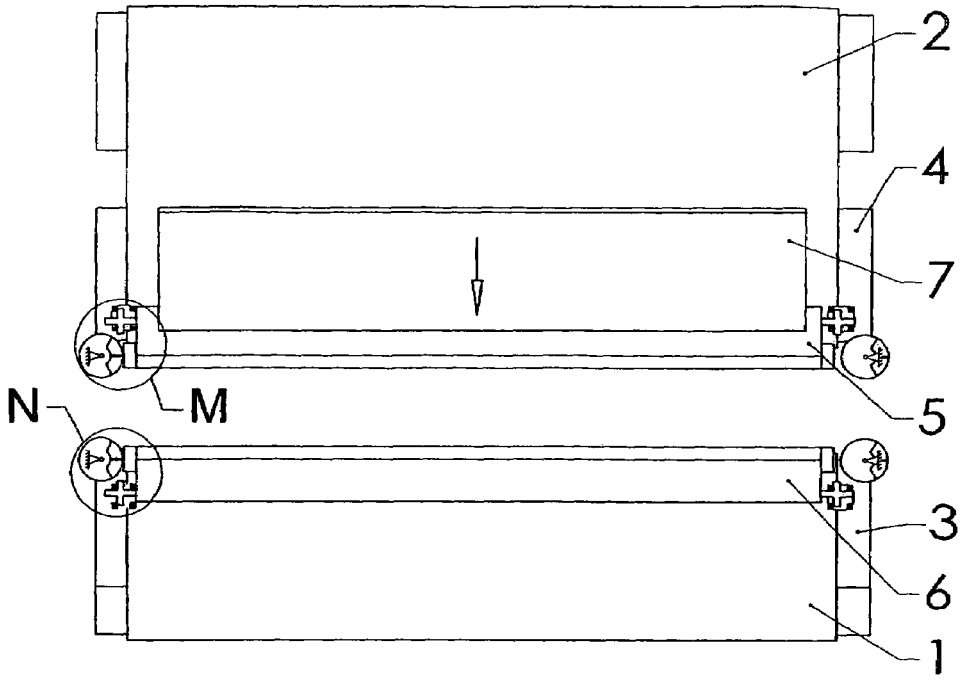
FIG. 4 shows a schematic side view of yet another embodiment of a device according to the invention, in which the vibrational motion of the brackets is generated in the plane Y-Z by means of magnetic reactions between magnets.
Figure 4A:
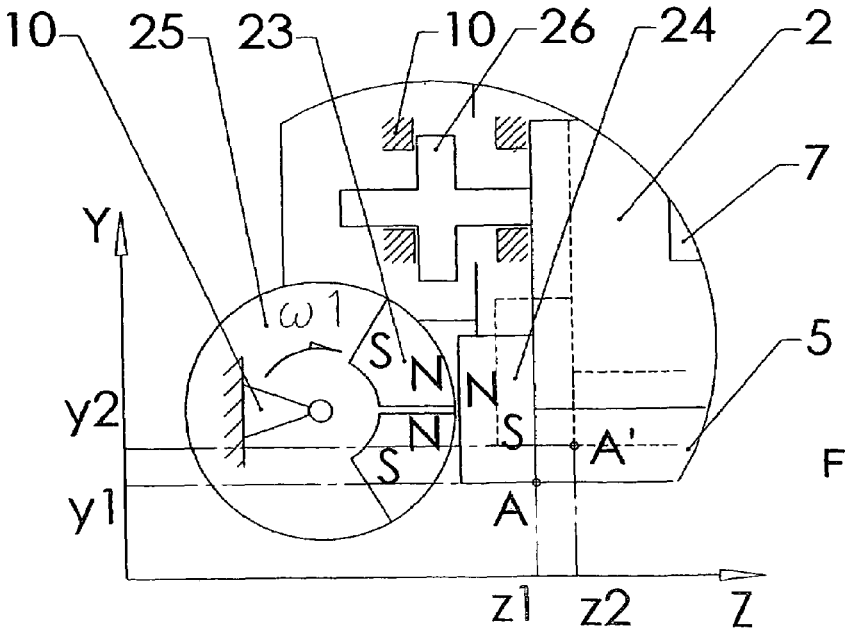
FIG. 4A shows an enlarged detail M from FIG. 4.
Figure 4B:
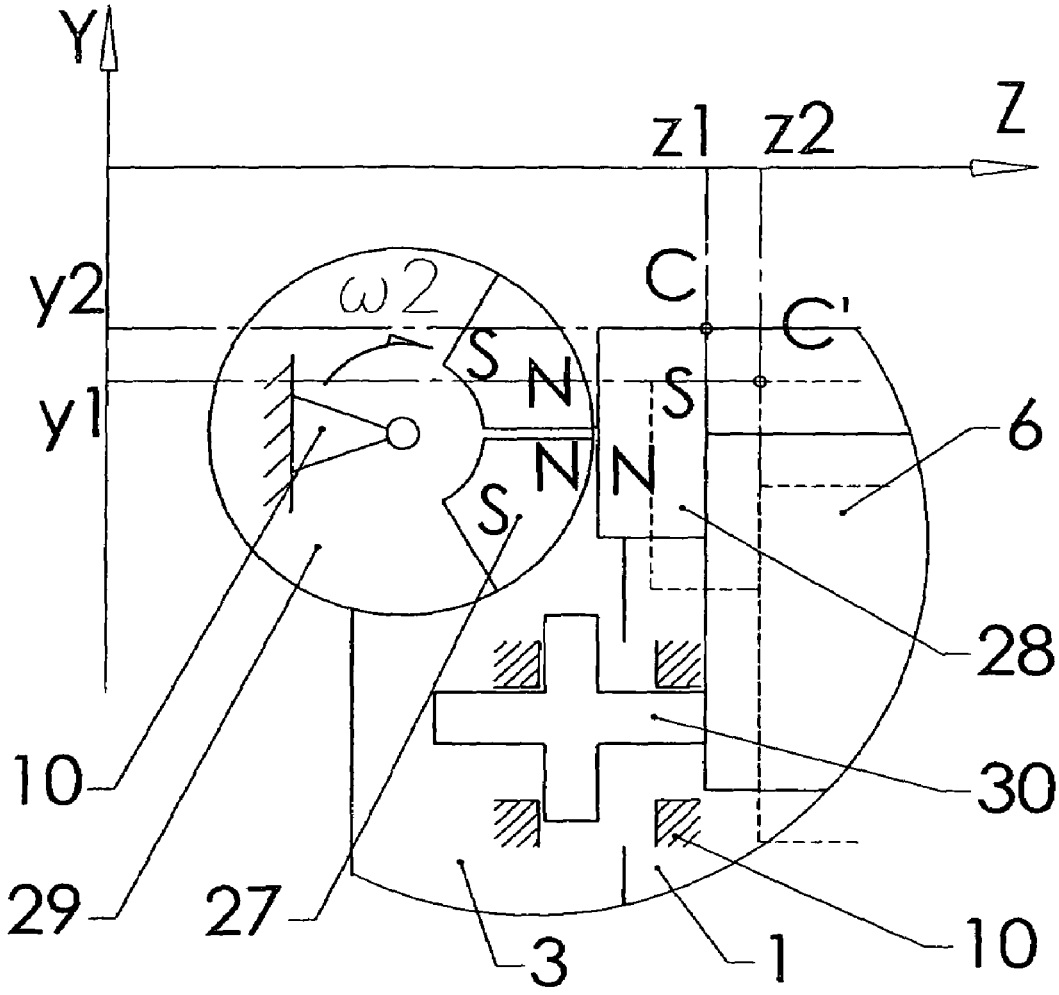
FIG. 4B shows an enlarged detail N from FIG. 4.

A similar embodiment is shown in FIGS. 3, 3A, 3B and in FIGS. 4, 4A, 4B, with the only difference being that the force forcing the vibrational motion of the brackets 5, 6 is generated by magnetic interaction between magnets 15, 16, 19, 20, 23, 2, 27, 28. The brackets 5, 6 are mounted to the support 10 via a movable assembly of magnets, which affect each other with the same poles, for example N-N or S-S, installed movably in spinning elements and inside the brackets, as shown in FIGS. 3 and 4.

According to the embodiment of the invention shown in FIGS. 3, 3A, 3B and FIGS. 4, 4A, 4B, where the vibrational motion of the brackets 5, 6 is generated, correspondingly, in the plane X-Y and/or Y-Z, by means of magnetic interaction between magnets 15, 16, 19, 20, 23, 24, 27, 28 arranged in the brackets 5, 6 and in movable holders, for example rollers 17, 21, 25, 29 secured to the support 10 and rotating with velocities ω1 and ω2. As shown in FIGS. 3 and 4, magnetic fields of the cooperating magnets are oriented with the same poles, i.e., such that only pairs of the same poles of the cooperating magnets interact cyclically, for example N-N or S-S, thus obtaining cyclical repulsive force which is strong enough to generate beneficial vibrations of the brackets 5, 6. The magnets are permanent magnets, for example neodymium magnets, and/or electromagnets.

Furthermore, the brackets 5, 6 may be connected to piezoelectric transducers and/or magnetostriction transducers, which generate the vibrational motion of the brackets.

The brackets 5, 6 may be connected with an assembly of hydraulic and/or pneumatic cylinders, which generate the vibrational motion of the brackets 5, 6.

The frequency of the vibrational motion of the brackets is controlled by adjustment of the frequencies ω1 [1/s], ω2 [1/s] of rotational rollers of the eccentric elements 8, 9, 11, 12 and/or 13, 14 and also movable holders of the magnets 17, 21 and/or 25, 29.

Depending on the frequency and the trajectory of the motion of the blade of the tool comminuting the material, for example the knife 7, one selects the optimal combination of the displacement of the edges A-B and C-D along the axis X and Y, the extreme displacement of the points A and C from the equilibrium position x0 being selected such that no collision with the detaching element, for example the blade of the comminuting knife 7, could occur during the operation of the device.

The invention claimed is:

1. A method for obtaining the continuity of the uniformity of the structure and density of a stream of transported loose tobacco material, in which:

previously loosened material is subjected to compacting during transportation between conveyors;

the compacted material is vibrated by an intermediate element that has at least one bracket that is arranged transversely to the direction of motion of the material; and directly after being vibrated, the compacted material is comminuted to a form preferable for further processing.

2. A method according to claim 1, wherein the intermediate element is vibrated in a vertical X-Y plane that is parallel to the direction of motion of the material and/or in a vertical Y-Z plane that is perpendicular to the X-Y plane.

3. A method according to claim 1, wherein the intermediate element is vibrated along a horizontal X axis that is on the same vertical plane as the direction of motion of the material and/or a vertical Y axis and/or a horizontal Z axis that is perpendicular to the X axis.

4. A method according to claim 1, wherein at least one of the at least one bracket arranged transversely to the direction of motion of the material is vibrated with an amplitude in the range from 0 to 4 mm.

5. A method according to claim 1, wherein at least one of the at least one bracket arranged transversely to the direction of motion of the material is vibrated with an amplitude in the range from 0 to 2 mm.

6. A method according to claim 1, wherein the intermediate element is vibrated at a frequency in the range from 20 Hz to 50 kHz.

7. A method according to claim 1, wherein parameters for the vibration of the intermediate element are set constant.

8. A method according to claim 1, wherein a plurality of intermediate elements are used to vibrate the material, each intermediate element has a bracket, and parameters for the vibration of each bracket are set and controlled independently.

9. A method for obtaining the continuity of the uniformity of the structure and density of a stream of transported loose tobacco material, in which:

previously loosened material is subjected to compacting during transportation between conveyors;

a plurality of intermediate elements are used to vibrate the material, each intermediate element has a bracket, and each bracket has different vibration parameters; and directly after being vibrated, the compacted material is comminuted to a form preferable for further processing.

10. A method according to claim 1, wherein at least two intermediate elements are used to vibrate the material, each intermediate element has a bracket, and the brackets have the same vibration parameters.

11. A method according to claim 1, wherein a force used to vibrate the bracket is measured and analyzed as a diagnostic signal that indicates the correctness of the process.

12. A method according to claim 1, wherein rollers are used to transport the material, the rollers are driven by a driving force, and a moment of the driving force driving the rollers is measured and analyzed as a diagnostic signal for optimizing the vibration of the bracket.

13. A method according to claim 1, wherein rollers are used to transport the material, the rollers are driven by a driving force, and a moment of the driving force driving the rollers is measured and analyzed as a diagnostic signal and a control signal for minimizing the force stretching transporting elements that are used to transport/compact the material.

14. A method according to claim 1, wherein rollers are used to transport the material, the rollers are driven by a driving force, and a moment of the driving force driving the rollers is measured and analyzed as a control signal for a device that feeds the processed material to transporting elements that are used to transport the material.

15. A device for obtaining the continuity of the uniformity of the structure and density of a stream of transported loose tobacco material, that has:

a set of conveyors;

a mouthpiece behind the conveyers;

a comminuting knife behind the mouthpiece; and a vibrating intermediate element that has at least one bracket in the mouthpiece that is located transversely to the direction of motion of the material.

16. A device according to claim 15, wherein the vibrating intermediate element includes brackets that are mounted to a support via a movable assembly of eccentric elements comprising an eccentric roller or an assembly of rollers installed eccentrically in an opening/openings inside the brackets that are mounted to the support.

17. A device according to claim 15, wherein the vibrating intermediate element includes brackets that are mounted to a support via a movable assembly of eccentric elements comprising an eccentric roller or an assembly of rollers installed eccentrically outside the brackets that are mounted to the support.

18. A device according to claim 15, wherein the vibrating intermediate element includes brackets that are mounted to a support via a movable assembly of magnets with the same poles N-N or S-S interacting cyclically.

19. A device according to claim 18, wherein the magnets are permanent magnets.

20. A device according to claim 18, wherein the magnets are electromagnets.

21. A device according to claim 15, wherein the vibrating intermediate element includes brackets that are connected to piezoelectric transducers that vibrate the brackets that they are connected to.

22. A device according to claim 15, wherein the vibrating intermediate element includes brackets that are connected to magnetostriction transducers that vibrate the brackets that they are connected to.

23. A device according to claim 15, wherein the vibrating intermediate element includes brackets that are connected with an assembly of hydraulic cylinders that vibrate the brackets that they are connected with.

24. A device according to claim 15, wherein the intermediate element includes brackets that are connected with an assembly of pneumatic cylinders that vibrate the brackets that they are connected with.

* * * * *

UNITED STATES PATENT AND TRADEMARK OFFICE

CERTIFICATE OF CORRECTION

PATENT NO. : 7,562,835 B2
APPLICATION NO. : 11/698421
DATED : July 21, 2009
INVENTOR(S) : Wojciech Chojnicki et al.

It is certified that error appears in the above-identified patent and that said Letters Patent is hereby corrected as shown below:

On the Cover Page:

Item (54), "DEVICES" should be -- DEVICE --.

At Column 1, line 1, "DEVICES" should be -- DEVICE --.

Signed and Sealed this

First Day of December, 2009

David J. Kappos

David J. Kappos
*Director of the United States Patent and Trademark Office*